US010639887B2

(12) United States Patent
Sakai et al.

(10) Patent No.: US 10,639,887 B2
(45) Date of Patent: May 5, 2020

(54) PRINTING APPARATUS

(71) Applicant: SEIKO EPSON CORPORATION, Tokyo (JP)

(72) Inventors: Nobuaki Sakai, Shiojiri (JP); Takao Yamamoto, Matsumoto (JP); Akira Ishikawa, Shiojiri (JP); Yusuke Makishima, Shiojiri (JP); Daiki Ishikawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/079,057

(22) PCT Filed: Jan. 31, 2017

(86) PCT No.: PCT/JP2017/003490

§ 371 (c)(1),
(2) Date: Aug. 22, 2018

(87) PCT Pub. No.: WO2017/145674

PCT Pub. Date: Aug. 31, 2017

(65) Prior Publication Data

US 2019/0047285 A1 Feb. 14, 2019

(30) Foreign Application Priority Data

Feb. 23, 2016 (JP) ..... 2016-031700

(51) Int. Cl.

| | |
|---|---|
| ***B41J 2/135*** | (2006.01) |
| ***B65H 20/02*** | (2006.01) |
| ***B41J 29/17*** | (2006.01) |
| ***B65H 23/04*** | (2006.01) |
| ***B41J 29/12*** | (2006.01) |

(Continued)

(52) U.S. Cl.

CPC ..... *B41J 2/135* (2013.01); *B41J 2/175* (2013.01); *B41J 2/1714* (2013.01); *B41J 11/0015* (2013.01); *B41J 29/12* (2013.01); *B41J 29/17* (2013.01); *B65H 20/02* (2013.01); *B65H 23/04* (2013.01); *B65H 2301/511* (2013.01); *B65H 2404/147* (2013.01); *B65H 2404/561* (2013.01); *B65H 2801/36* (2013.01)

(58) Field of Classification Search

CPC ..... B41J 2/135; B41J 2/0057; B41J 29/17
USPC ..... 347/103, 104
See application file for complete search history.

(56) References Cited

U.S. PATENT DOCUMENTS

| | | | | |
|---|---|---|---|---|
| 9,878,562 | B2 * | 1/2018 | Ueyama | B41J 11/02 |
| 10,059,128 | B2 * | 8/2018 | Miyazaki | B41J 11/58 |
| 2006/0238596 | A1 * | 10/2006 | Mitsuhashi | B41J 11/007 347/104 |

FOREIGN PATENT DOCUMENTS

| | | |
|---|---|---|
| CN | 203818765 | 9/2014 |
| JP | 56-044154 U | 9/1979 |

(Continued)

OTHER PUBLICATIONS

International Search Report dated Apr. 4, 2017 for PCT/JP2017/003490.

*Primary Examiner* — An H Do
(74) *Attorney, Agent, or Firm* — Workman Nydegger

(57) ABSTRACT

A printing apparatus includes a transport unit that transports a medium in a transport direction, a printing unit that prints on a printing surface of the medium, and a removal unit that is provided on an upstream side in the transport direction with respect to the transport unit and is provided so as to come into contact with the printing surface.

10 Claims, 6 Drawing Sheets

(51) Int. Cl.

| | |
|---|---|
| ***B41J 11/00*** | (2006.01) |
| ***B41J 2/17*** | (2006.01) |
| ***B41J 2/175*** | (2006.01) |

(56) References Cited

FOREIGN PATENT DOCUMENTS

| | | | |
|---|---|---|---|
| JP | S59-35950 | | 2/1984 |
| JP | 02-099658 | U | 8/1990 |
| JP | H03-61982 | | 3/1991 |
| JP | 03-239279 | A | 10/1991 |
| JP | 10-265075 | A | 10/1998 |

* cited by examiner

PRINTING APPARATUS

The entire disclosure of Japanese Patent Application No. 2016-031700, filed on Feb. 23, 2016 is expressly incorporated by reference herein.

TECHNICAL FIELD

The present invention relates to a printing apparatus.

BACKGROUND ART

An ink jet type printer, which is an example of a printing apparatus, is provided with a transport unit that transports a medium, and a recording head that includes a nozzle formation surface, which discharges ink, and prints a desired image on a medium by alternately repeating an operation that discharges ink from the nozzle formation surface while moving the recording head in a direction that intersects a transport direction, and an operation that transports the medium in the transport direction. In addition, since the nozzle formation surface is disposed in proximity to the medium in order to deposit discharged ink accurately in a predetermined position, it is likely that the nozzle formation surface will be stained by the foreign matter adhered to the medium in a section that prints an image.

Printing apparatuses are used in environments in which foreign matter such as dust, fluff, and the like, is present. Therefore, it is likely that the foreign matter caused by environmental factors will adhere to the medium and be taken inside the printing apparatus. If the foreign matter is taken into a section that prints an image, there is a concern that the nozzle formation surface will be stained by the foreign matter, that the ink discharge performance of the recording head will change, and therefore, that there will be a decrease in the printing quality of an image.

For example, the printer (printing apparatus) disclosed in PTL 1 includes a dust removal member for removing dust, and suppresses the adverse effects of foreign matter by removing dust (foreign matter) adhered to a roller by using the dust removal member.

To explain in more detail, the dust removal member is a brush, and removes foreign matter by scraping away the foreign matter adhered to the roller by using the brush.

CITATION LIST

Patent Literature

PTL 1: JP-A-10-265075

SUMMARY OF INVENTION

Technical Problem

However, in the printing apparatus disclosed in PTL 1, there is a concern that the foreign matter scraped away by the brush will be scattered in the periphery, adhere to the medium, or the like, and stain the nozzle formation surface. Furthermore, since a configuration that removes the foreign matter adhered to a medium due to environmental factors is not included, there is a concern that the foreign matter adhered to the medium due to environmental factors will stain the nozzle formation surface, that the ink discharge performance of the recording head will change, and therefore, that there will be a decrease in the printing quality of an image.

Solution to Problem

The invention can be realized as the following aspects or application examples.

Application Example 1

According to this application example, there is provided a printing apparatus including a transport unit that transports a medium in a transport direction, a printing unit that prints on a printing surface of the medium, and a removal unit that is provided on an upstream side in the transport direction with respect to the transport unit and is provided so as to come into contact with the printing surface.

There is a concern that foreign matter caused by environmental factors (for example, airborne dust and fluff) and foreign matter caused by non-environmental factors (for example, foreign matter arising during handling of a medium, foreign matter in a process for manufacturing the medium, and the like) will adhere to the printing surface of the medium, and will stain the transport unit and the printing unit.

Since the removal unit is provided so as to come into contact with the printing surface of the medium on the upstream side in the transport direction with respect to the transport unit, it is possible to remove foreign matter adhered to the printing surface of the medium by transporting the medium in the transport direction. As a result of the removal unit removing the foreign matter adhered to the printing surface of the medium, it is unlikely that the transport unit or the printing unit, which are provided on the downstream side in the transport direction with respect to the removal unit, will be stained by the foreign matter.

Accordingly, it is unlikely that the printing unit will be stained by the foreign matter, and therefore, it is possible to suppress adverse effects of the foreign matter, and a decrease in printing quality, for example.

Application Example 2

In the printing apparatus according to the application example, it is preferable that the removal unit include a removal member that comes into contact with the printing surface and a holding member that holds the removal member, and that the removal member be an aggregate of fibers.

If the removal member is configured by using an aggregate of fibers, it is possible to provide protrusions and recesses in the outer surface (a surface that comes into contact with foreign matter on the removal member) of the removal member. If the surface that comes into contact with foreign matter has protrusions and recesses, it is possible to strengthen a force (a frictional force) that removes foreign matter and to enhance the foreign matter removal performance of the removal member in comparison with a case in which the surface that comes into contact with foreign matter is smooth.

Furthermore, if the removal member is configured by an aggregate of fibers, spaces are provided in the inner portion of the removal member, and therefore, it is possible to trap (hold) the foreign matter in the spaces. If spaces are provided in the inner portion of the removal member, it is possible to enhance the foreign matter trapping performance of the removal member in comparison with a case in which spaces are not provided in the inner portion of the removal member.

Application Example 3

In the printing apparatus according to the application example, it is preferable that the removal member have a conductive property.

If the removal member has a conductive property, it is possible to neutralize a charge (for example, static electricity) accumulated on the medium. For example, if foreign matter adheres to the medium due to an electrostatic force, the electrostatic force that causes the foreign matter to adhere to the medium is weakened by neutralizing the medium by using the removal member, and therefore, it is likely that the foreign matter will be removed from the printing surface of the medium.

Application Example 4

In the printing apparatus according to the application example, it is preferable that the transport unit include a plurality of rollers, and that the removal unit be positioned further on the upstream side in the transport direction than a roller that is positioned furthest on the upstream side among the plurality of rollers.

If foreign matter adheres to any of the plurality of rollers, there is a concern that foreign matter adhered to a roller will adhere to the printing surface of the medium again, will be taken into and stain the printing unit leading to a decrease in printing quality.

Since the removal unit is positioned further on the upstream side in the transport direction than a roller that is positioned furthest on the upstream side among the plurality of rollers, foreign matter adhered to the printing surface of the medium is removed by the removal unit, and therefore, it is unlikely that the plurality of rollers will be stained. Accordingly, it is possible to suppress a concern that the foreign matter adhered to a roller will stain the printing unit leading to a decrease in printing quality.

Application Example 5

It is preferable that the printing apparatus according to the application example further include a setting unit in which a rolled body in which the medium is wound in a rolled form, can be mounted and which reels out the medium to the transport unit, and that the removal unit be disposed between the setting unit and the transport unit.

A printing apparatus having a configuration that prints on a medium wound in a rolled form can print on a longitudinal medium more efficiently than a printing apparatus having a configuration that prints on single sheet paper.

Since the removal unit is disposed between the setting unit that reels out a medium wound in a rolled form and the transport unit, foreign matter adhered to the printing surface of the medium is removed by the removal unit, and it is unlikely that the transport unit or the printing unit, which are provided on the downstream side in the transport direction with respect to the removal unit, will be stained.

Application Example 6

In the printing apparatus according to the application example, it is preferable that a surface of the holding member to which the removal member is fixed be inclined to the upstream side in the transport direction with respect to a direction that is orthogonal to the printing surface.

In a case in which the removal member does not come into contact with the medium, the removal member is disposed so as to be parallel with the surface (hereinafter, referred to as a fixing surface) of the holding member to which the removal member is fixed, and the fixing surface and the removal member have the same inclination with respect to the printing surface. For example, if the fixing surface is disposed inclined to the upstream side in the transport direction with respect to the direction that is orthogonal to the printing surface, the removal member is disposed inclined to the upstream side in the transport direction with respect to the direction that is orthogonal to the printing surface. If the fixing surface is disposed inclined to the downstream side in the transport direction with respect to the direction that is orthogonal to the printing surface, the removal member is disposed inclined to the downstream side in the transport direction with respect to the direction that is orthogonal to the printing surface.

In a case in which the removal member comes into contact with the medium, a force (hereinafter, referred to as a force in the transport direction) that causes the medium curve in the transport direction is applied to the removal member from the medium, the removal member curves in the transport direction, and the medium is transported in the transport direction. Meanwhile, a force (hereinafter, referred to as resistance) that resists the force in the transport direction is applied to the medium from the removal member. The resistance is a reaction force to the force in the transport direction, is applied in a direction opposite the transport direction, and inhibits transport of the medium. In addition, the resistance is also applied to the foreign matter adhered to the printing surface of the medium, and corresponds to a force that removes the foreign matter.

If the removal member is inclined to the upstream side in the transport direction with respect to the direction that is orthogonal to the printing surface, since it is more likely that the removal member will curve in the transport direction than in a case in which the removal member is inclined to the downstream side in the transport direction with respect to the direction that is orthogonal to the printing surface, the force in the transport direction (the force that causes the medium to curve) is weaker, and therefore, the resistance is also weaker. Since the resistance is weaker, it is less likely that transport of the medium will be inhibited.

Accordingly, in order to make it unlikely that transport of the medium will be inhibited, it is preferable that the removal member be disposed inclined to the upstream side in the transport direction with respect to the direction that is orthogonal to the printing surface. Since the fixing surface and the removal member have the same inclination with respect to the printing surface (the direction that is orthogonal to the printing surface), it is preferable that the fixing surface (the surface to which the removal member is fixed) of the holding member be disposed inclined to the upstream side in the transport direction with respect to the direction that is orthogonal to the printing surface.

Application Example 7

In the printing apparatus according to the application example, it is preferable that an angle formed by a surface of the holding member to which the removal member is fixed and the printing surface be 60°-90°.

In a case in which the removal member is disposed inclined to the upstream side in the transport direction with respect to the direction that is orthogonal to the printing surface, when the removal member is disposed at a steep inclination with respect to the printing surface of the medium, since it is less likely that the removal member will curve in the transport direction than in a case in which the removal member is disposed at a gentle inclination with respect to the printing surface of the medium, the force in the transport direction is stronger, and therefore, the resistance is also stronger.

Meanwhile, in a case in which the removal member is disposed inclined to the upstream side in the transport direction with respect to the direction that is orthogonal to the printing surface, when the removal member is disposed at a gentle inclination with respect to the printing surface of the medium, since it is more likely that the removal member will curve in the transport direction than in a case in which the removal member is disposed at a steep inclination with respect to the printing surface of the medium, the force in the transport direction is weaker, and therefore, the resistance is also weaker.

Since the resistance is a force that removes foreign matter adhered to the printing surface of the medium, in a case in which the removal member is disposed inclined to the upstream side in the transport direction with respect to the direction that is orthogonal to the printing surface in order to strengthen the force that removes foreign matter adhered to the printing surface of the medium, it is preferable that the removal member be disposed at a steep inclination with respect to the printing surface of the medium, and that the resistance be strengthened. Accordingly, in a case in which the removal member does not come into contact with the medium, it is preferable that the angle formed by the removal member and the printing surface be a steep inclination of 60°-90°. Since the fixing surface and the removal member have the same inclination with respect to the printing surface, it is preferable that the angle formed by the fixing surface (the surface to which the removal member is fixed) of the holding member and the printing surface be a steep inclination of 60°-90°.

DESCRIPTION OF EMBODIMENTS

Figure 1:
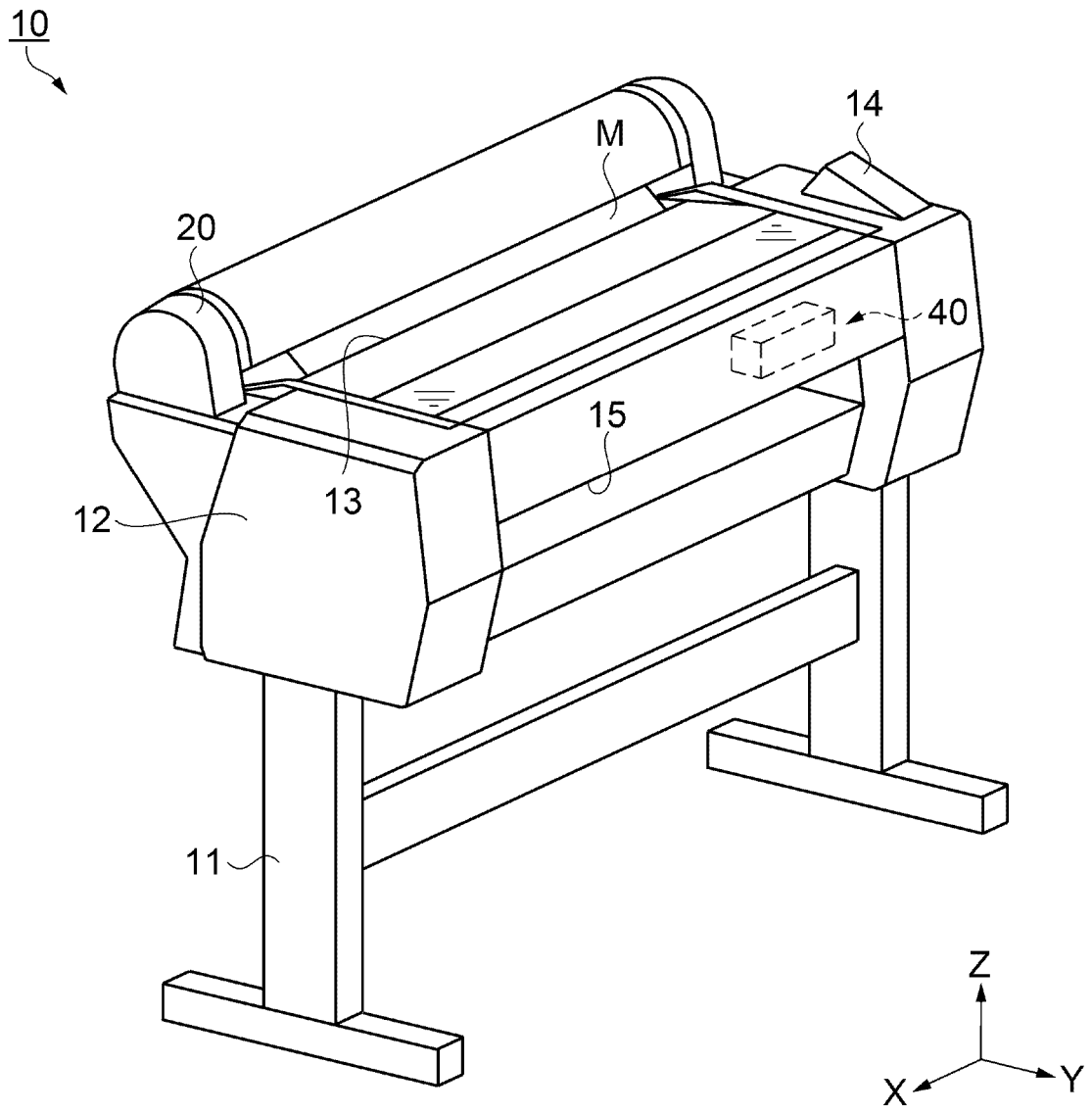
FIG. 1 is a perspective view of a printing apparatus according to an embodiment.

Hereinafter, an embodiment of the invention will be described with reference to the drawings. The embodiment illustrates aspects of the invention, but does not limit the invention, and can be changed arbitrarily within the range of the technical idea of the invention. In addition, in each of the drawings below, the scales of each layer and each location are altered in order to make each layer and each location have a size that is easy to understand in the drawings.

Embodiment

Summary of Printing Apparatus

Figure 2:
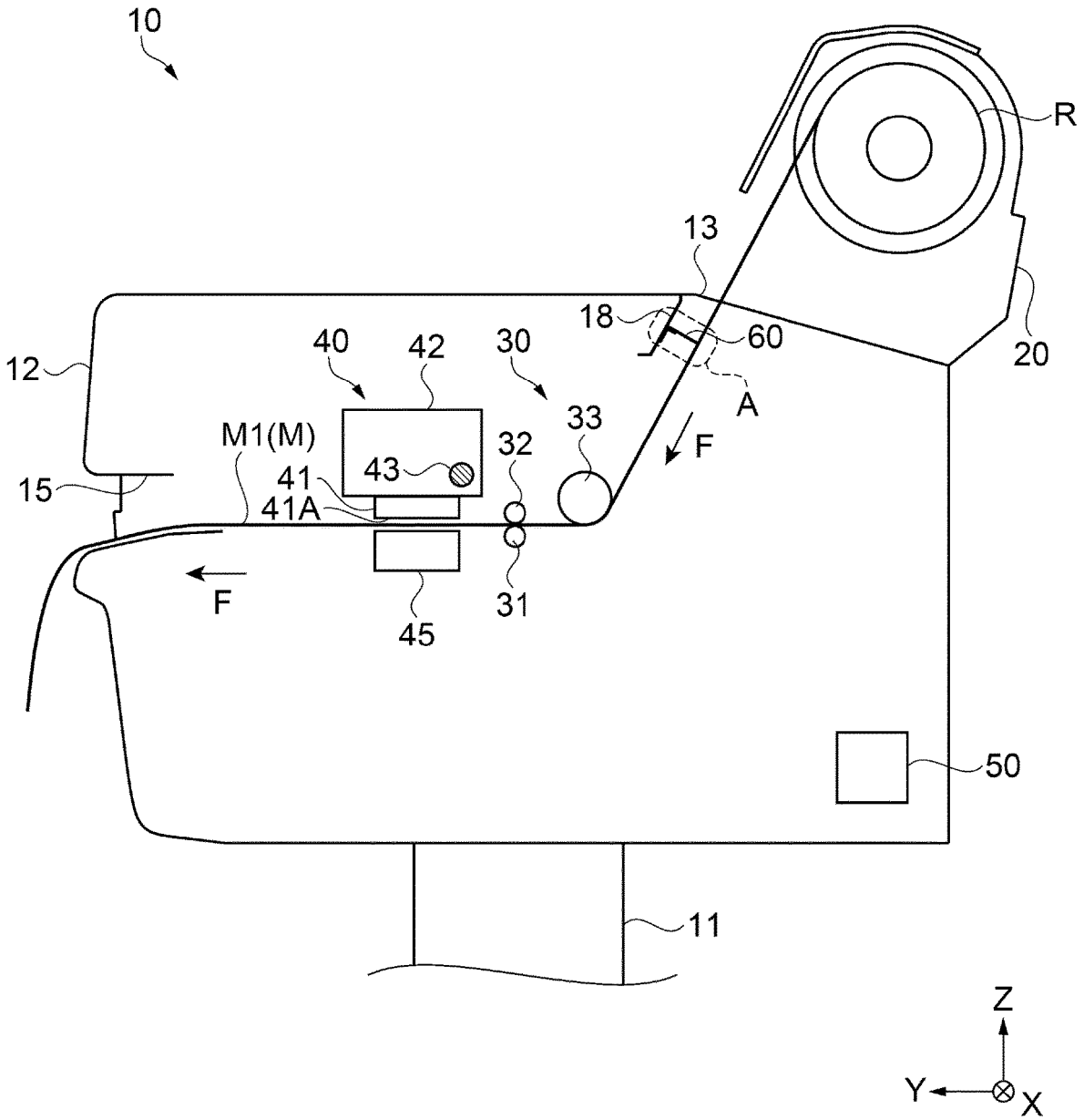
FIG. 2 is a schematic view that shows a schematic configuration of the printing apparatus according to the embodiment.

FIG. 1 is a perspective view of a printing apparatus according to the embodiment. FIG. 2 is a schematic diagram that shows a schematic configuration of the printing apparatus according to the present embodiment.

Firstly, a summary of a printing apparatus 10 will be described with reference to FIGS. 1 and 2.

As shown in FIG. 1, the printing apparatus 10 according to the present embodiment is a large format printer (LFP) that handles a longitudinal medium (sheet of paper) M. The printing apparatus 10 is provided with a pair of leg portions 11, a substantially rectangular parallelepiped housing portion 12 that is supported by the leg portions 11, and a setting unit 20 that reels out (feeds) the medium M to the housing portion 12.

In the description from this point onwards, an up-down direction that runs parallel to the gravity direction is defined as a Z axis, and a +Z axis direction is defined as "up". A longitudinal direction (the width direction of the medium M) of the housing portion 12, which intersects the Z axis, is defined as an X axis, and a −X axis direction is defined as "right". A direction in which the medium M is transported, which intersects both the Z axis and the X axis, is defined as a Y axis, and a +Y axis direction is defined as "front".

The setting unit 20 is provided so as to project upward (in a +Z axis direction) from a back surface (a surface on the −Y axis side) of the housing portion 12. A rolled body R (refer to FIG. 2), in which the medium M is wound in cylindrical form (rolled form) is accommodated in the setting unit 20. The medium M is reeled out from the rolled body R and is supplied to a printing main body portion 40 inside the housing portion 12 as a result of the rolled body R being driven in a rotational manner by a driving motor (not illustrated in the drawings). That is, the printing apparatus 10 has the setting unit 20 in which it is possible to mount the rolled body R in which the medium M is wound in a rolled form, and which reels out the medium M to the printing main body portion 40.

For example, the medium M is configured by a fabric such as polyester, paper, film, or the like.

Additionally, a plurality of sizes of rolled body R, having different medium M widths (lengths in the X direction) and winding numbers, can be loaded into the setting unit 20 in an exchangeable manner. Regardless of size, the rolled body R is loaded into the setting unit 20 in a state of being flush with a first end side (a right end side in FIG. 1) in the X direction. That is, in the printing apparatus 10, an alignment reference position of the medium M is set on the first end side in the X direction.

The housing portion 12 includes a feeding port 13, an ejection port 15, a manipulation portion 14, and the like. The feeding port 13 is provided in a back-surface upper portion of the housing portion 12. The medium M, which is reeled out from the rolled body R that is accommodated in the setting unit 20, is fed to an inner portion of the housing portion 12 from the feeding port 13. The manipulation portion 14 is an upper portion of the housing portion 12, and is provided on a right end (an end on the −X axis side) in the longitudinal direction of the housing portion 12. Various settings for causing an image, or the like, to be printed on the medium M are input from the manipulation portion 14 by a user. The ejection port 15 is provided on a front surface of the housing portion 12. The medium M printed by the printing main body portion 40 is ejected to an outer portion of the housing portion 12 from the ejection port 15.

As shown in FIG. 2, in an inner portion of the housing portion 12, the printing apparatus 10 is provided with a transport unit 30 that transports the medium M in a transport direction F, the printing main body portion 40 that prints on a printing surface M1 of the medium M, a control portion 50 that controls operations of the transport unit 30 or the printing main body portion 40, and a removal unit 60 removes foreign matter adhered to the medium M.

The transport unit 30 transports the medium M, which is reeled out from the setting unit 20 above the housing portion 12, in the transport direction F, and feeds out the medium M to the printing main body portion 40. The transport unit 30 includes a plurality of rollers 31, 32, and 33 (a driving roller 31, a driven roller 32, and a guide roller 33) that are positioned further on the upstream side than the printing main body portion 40 in the transport direction F of the medium M.

The guide roller 33 is positioned furthest on the upstream side in the transport direction F among the plurality of rollers 31, 32, and 33 in the transport unit 30. The guide roller 33 guides the medium M, which is reeled out from the setting unit 20, to the printing main body portion 40. The driven roller 32 is brought into a pressing contact with the driving roller 31 via the medium M, and is driven to rotate. The driving roller 31 clamps the medium M with the driven roller 32. The medium M is transported in the transport direction F as a result of the driving roller 31 being driven in a rotational manner by a driving motor (not illustrated in the drawings).

The printing main body portion 40 is provided with a recording head 41 that discharges ink toward the printing surface M1 of the medium M, a carriage 42 that holds the recording head 41, a platen 45 that supports the medium M, and a guide shaft 43 that supports the carriage 42.

The recording head 41 prints images on the printing surface M1 of the medium M by discharging ink. In other words, the recording head 41 functions as a printing unit that prints on the printing surface M1 of the medium M. Additionally, as long as the printing unitprints of an image on the medium M, the printing unit may have a configuration that transfers an image onto the medium M.

The recording head 41 is provided with a plurality of nozzles (not illustrated in the drawings), and is capable of discharging ink. The carriage 42, which holds the recording head 41, reciprocates in the width direction (the X axis direction) of the medium M as a result of the motive power of the driving motor (not illustrated in the drawings). The platen 45 is provided with a substantially rectangular surface, in which the width direction of the medium M is set as the longitudinal direction, on the upper surface thereof, which faces the recording head 41. The medium M is supported using suction on the upper surface of the platen 45 as a result of a negative pressure that is applied to the platen 45. As a result of this, a decrease in printing quality due to lifting of the medium M is prevented.

The printing surface M1 of the medium M is disposed facing a nozzle formation surface 41A of the recording head 41, and is a surface at which ink is discharged from the recording head 41.

In the printing apparatus 10, a predetermined image is printed on the printing surface M1 of the medium M by aligning rows (raster lines) of a plurality of dots as a result of alternately repeating an operation in which the printing main body portion 40 causes ink to be discharged onto the printing surface M1 of the medium M from the recording head 41 while causing the carriage 42 to reciprocate in the X axis direction, and an operation in which the transport unit 30 causes the medium M to be transported in the transport direction F.

Additionally, in the present embodiment, a serial head type recording head, which is mounted in the reciprocating carriage 42, and discharges ink while moving in the width direction (the X axis direction) of the medium M, is illustrated as the recording head 41 by way of example, but a line head type recording head that is fixedly arranged extending in the width direction (the X axis direction) of the medium M may also be used.

A fixing member 18 is provided between the guide roller 33 (the transport unit 30) and the rolled body R (the setting unit 20). The fixing member 18 is a member for fixing the removal unit 60.

In the above-mentioned manner, a plurality of sizes of the rolled body R, having different medium M widths and winding numbers, can be loaded into the setting unit 20 in an exchangeable manner. A user loads a required rolled body R into the setting unit 20 by handling the rolled body R. There is a concern that foreign matter such as fluff and dust will adhere to the printing surface M1 of the medium M as a result of handling work of the rolled body R, that is, as a result of a work factor. Furthermore, there is a concern that foreign matter such as airborne dust and fluff will adhere to the printing surface M1 of the medium M due to an environmental factor where the printing apparatus 10 is installed.

For example, if foreign matter adhered to the printing surface M1 of the medium M is swirled up by a jet flow of ink during the discharge of ink, and adhered to the nozzle formation surface 41A of the recording head 41, it is likely that a defect in which ink is not uniformly discharged from the plurality of nozzles provided in the nozzle formation surface 41A will occur. To explain in more detail, when a portion of a nozzle is blocked by foreign matter, it is unlikely that ink will be discharged from the blocked nozzle, a difference arises in the contrast between a raster line formed by the blocked nozzle and a raster line formed by an unblocked nozzle, and therefore, it is likely that a printing defect such as printing irregularities will occur.

In this manner, there is a concern that foreign matter adhered to the printing surface M1 of the medium M as a result of a work factor or an environmental factor will stain the nozzle formation surface 41A of the recording head 41 leading to a printing defect such as printing irregularities. Therefore, in the printing apparatus 10, the removal unit 60, which removes the foreign matter adhered to the printing surface M1 of the medium M, is provided between the setting unit 20 and the transport unit 30, and the foreign matter adhered to the printing surface M1 of the medium M is not taken to the downstream side in the transport direction F with respect to the removal unit 60.

That is, the removal unit 60 is disposed between the setting unit 20 and the transport unit 30. To explain in more detail, the removal unit 60 is provided on the upstream side in the transport direction F with respect to the transport unit 30, and is provided so as to come into contact with the printing surface M1 of the medium M. To explain in still more detail, the transport unit 30 has the plurality of rollers 31, 32, and 33, and the removal unit 60 is positioned further on the upstream side in the transport direction F than the guide roller 33, which is positioned furthest on the upstream side in the transport direction F among the plurality of rollers 31, 32, and 33.

Summary of Removal Portion

Figure 3:
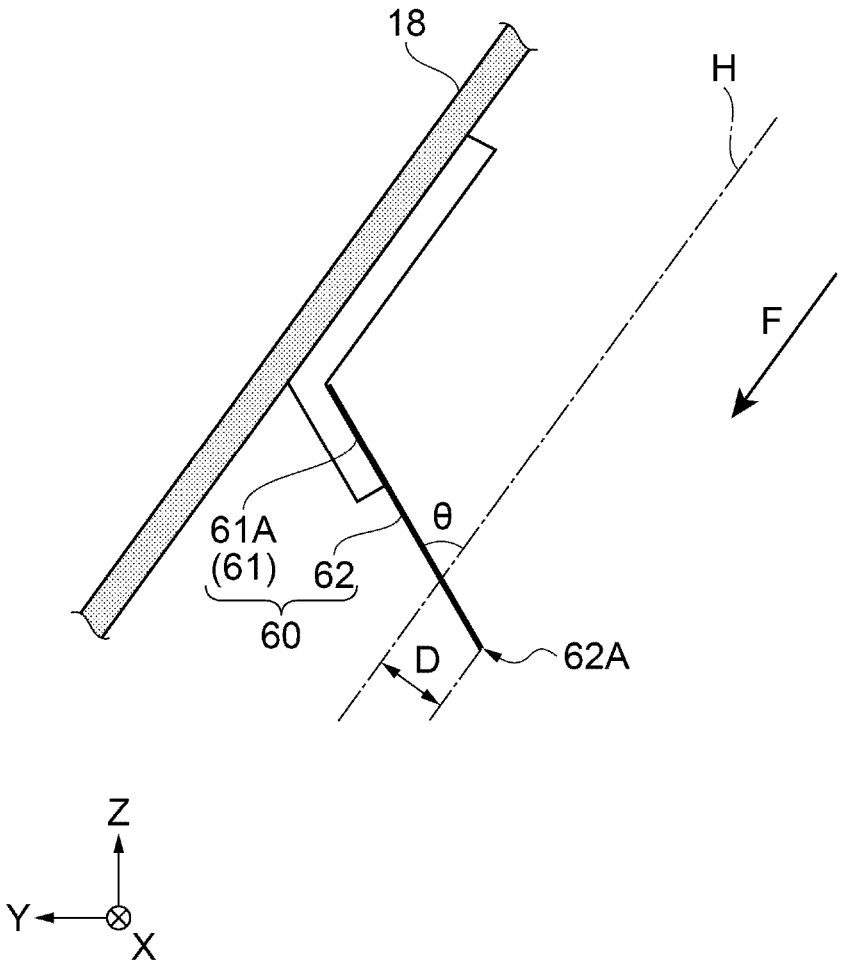
FIG. 3 is a schematic view that shows a state of a removal unit.
Figure 4:
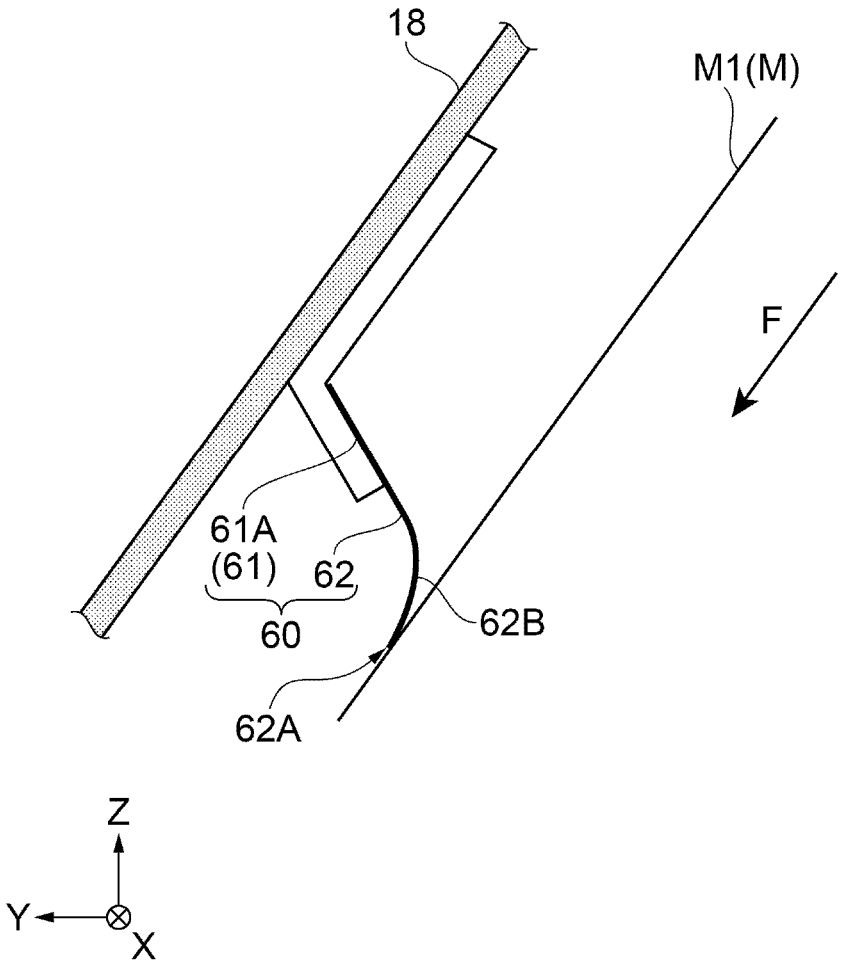
FIG. 4 is a schematic view that shows a state of the removal unit.
Figure 5:
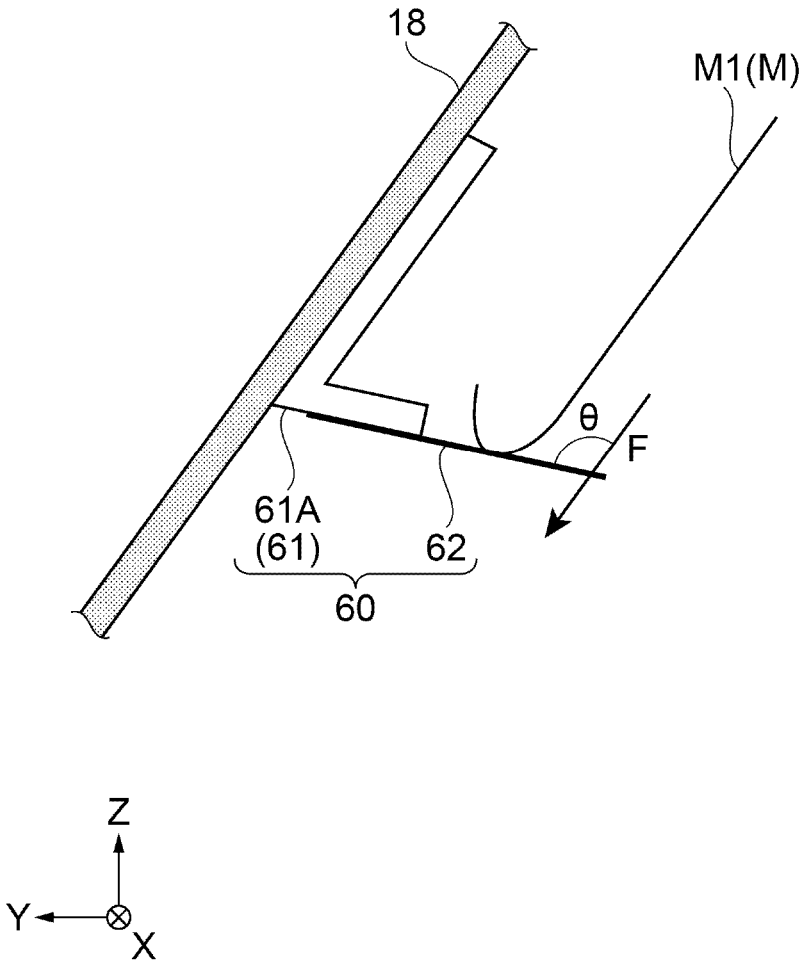
FIG. 5 is a schematic view that shows a state of the removal unit.

FIGS. 3 and 5 are enlarged views of a region A that is surrounded by a broken line in FIG. 2, and are schematic views that show states of the removal unit. To explain in more detail, FIG. 3 is a schematic view that shows a state of the removal unit 60 in a case in which the medium M is not being transported. FIG. 4 is a schematic view that shows a state of the removal unit 60 in a case in which the medium M is being transported. FIG. 5 is a schematic view that shows a state of the removal unit 60 in a case in which transport of the medium M is inhibited. Additionally, in FIG. 3, a transport surface H of the medium M is shown using a dashed-dotted line.

The transport surface H of the medium M is a virtual surface that is equivalent to the printing surface M1 of the medium M.

Hereinafter, a summary of the removal unit 60 will be described with reference to FIGS. 3 to 5.

As shown in FIG. 3, the removal unit 60 includes a holding member 61 and a removal member 62. The removal member 62 is a member that removes foreign matter on the printing surface M1 by come into contact with the printing surface M1 when the printing surface M1 passes through a region in which the removal unit 60 is provided. Further, the holding member 61 is a member that holds the removal member 62. For example, the holding member 61 is a member that is formed by carrying a folding process on a resin plate, and is fixed to the fixing member 18 via an adhesive sheet (not illustrated in the drawings), for example. The holding member 61 has a surface 61A to which the removal member 62 is fixed. In summary, the removal unit 60 has the removal member 62, which comes into contact with the printing surface M1, and the holding member 61, which holds the removal member.

Additionally, for example, the holding member 61 may be a metal plate on which sheet metal processing has been carried out, or may be a molded article of a resin. In addition, for example, the holding member 61 may be fixed to the fixing member 18 by using an adhesive, or may be fixed to the fixing member 18 by using a member such as a screw.

The removal member 62 is an oblong (band form) member in which the width direction of the medium M in the X axis direction is set as the longitudinal direction. The removal member 62 is a non-woven fabric that is formed by partially bonding fibers. That is, the removal member 62 is an aggregate of fibers.

To explain in more detail, the removal member 62 is an aggregate of fibers having a conductive property. For example, the fibers that configure the removal member 62 include fibers composed of a polymer having a main chain with a structure in which double bonds and single bonds are alternately aligned, or a fiber composed of a conductive polymer such as a polypyrrole polymer, a polythiophene polymer, a polyaniline polymer, or a polyacetylene polymer.

The removal member 62 extracts a charge (static electricity) accumulated on the medium M, and neutralizes the charge accumulated on the medium M by electrically discharging the charge to the air. In the present embodiment, the removal member 62 is attached to the holding member 61 in a state of not being connected to ground.

Additionally, the removal member 62 may have a configuration that is connected to ground, and if the removal member 62 is connected to ground, it is possible to enhance the neutralization performance of the removal member 62.

In a case in which foreign matter adheres to the printing surface M1 of the medium M as a result of an electrostatic force, the electrostatic force is weakened if the medium M is neutralized by the removal member 62, and it is likely that the foreign matter adhered to the printing surface M1 of the medium M will be removed. Accordingly, as a result of the removal member 62 having a conductive property, it is likely that the removal unit 60 will remove the foreign matter adhered to the printing surface M1 of the medium M.

The removal member 62 may be an aggregate of fibers that do not have a conductive property. For example, the fibers that configure the removal member 62 may also use a synthetic fiber such as a polyester fiber, a polyamide fiber, or a polyolefin fiber, a semi-synthetic fiber such as an acetate, a regenerated fiber such as cupra or rayon, or a natural fiber such as cotton.

The removal member 62 may be an aggregate of fibers that have a conductive property and fibers that do not have a conductive property.

The removal member 62 may be a felt configured in a cloth form by entwining fibers.

The removal member 62 may be a cloth formed by weaving or knitting fibers.

It is preferable that the removal member 62 be configured by fibers having excellent mechanical strength and rigidity. In the present embodiment, the fibers (fibers having a conductive property) that configure the removal member 62 have a higher young's modulus (mechanical strength) than polyethylene and nylon, for example.

As shown in FIG. 3, in a case in which the removal member 62 is not in contact with the printing surface M1 of the medium M, the removal member 62 is disposed so as to be parallel to the surface 61A of the holding member 61, and the removal member 62 and the surface 61A of the holding member 61 have the same inclination with respect to the transport surface H. Furthermore, in a case of viewing from the X direction, the removal member 62 is a flat surface that extends in an intersecting direction with the transport surface H (the transport direction F), and does not curve.

Additionally, in a case in which the removal member 62 is not in contact with the printing surface M1 of the medium M, as long as the removal member 62 is disposed so as to be substantially parallel to the surface 61A of the holding member 61, the removal member 62 need not necessarily be completely parallel thereto. In addition, in a case of viewing from the X direction, the removal member 62 may also have a configuration that has a curved surface, which curves.

As shown in FIG. 3, the angle formed by the removal member 62 and the transport surface H is defined as 0, and from this point onwards, will be referred to as a disposition angle θ of the removal member 62. The disposition angle θ of the removal member 62 is the angle formed by the removal member 62 and the transport surface H, and therefore, is the angle formed by the removal member 62 and the transport direction F. The removal member 62 is disposed inclined to the upstream side in the transport direction F with respect to a direction that is orthogonal to the transport surface H, and the disposition angle θ of the removal member 62 is an acute angle.

A separation distance (distance in the direction that is orthogonal to the transport surface H) of a tip end 62A of the removal member 62 and the transport surface H is given the reference numeral D, and from this point onwards, will be referred to as a disposition dimension D of the removal member 62. In the present embodiment, the disposition dimension D of the removal member 62 is set so that the tip end 62A of the removal member 62 comes into contact with the printing surface M1 of the medium M in a stable manner (in a manner corresponding to the state shown in FIG. 4). That is, the length of the removal member 62 in a direction that intersects the X axis direction (the length of the short edge of the removal member 62) is adjusted so that the tip end 62A of the removal member 62 comes into contact with the printing surface M1 of the medium M in a stable manner.

In a case in which the removal member 62 is not in contact with the printing surface M1 of the medium M, since the removal member 62 and the surface 61A of the holding member 61 have the same inclination with respect to the transport surface H and the transport surface H is equivalent to the printing surface M1 of the medium M, the surface 61A of the holding member 61 is disposed inclined to the upstream side in the transport direction F with respect to the direction that is orthogonal to the printing surface M1 (the transport surface H).

Furthermore, since the disposition angle θ of the removal member 62 is the angle formed by the surface 61A of the holding member 61 and the printing surface M1 (the transport surface H), it is possible to adjust the disposition angle θ of the removal member 62 by adjusting the angle formed by the surface 61A of the holding member 61 and the printing surface M1.

As shown in FIG. 4, if the medium M is transported from the setting unit 20 toward the transport unit 30, the removal member 62 is in contact with the printing surface M1 of the medium M, and a force in the transport direction F acts on the removal member 62 from the medium M. Therefore, the tip end 62A of the removal member 62 curves in the transport direction F, and a surface 62B of the removal member 62 comes into contact with the printing surface M1 of the medium M.

The surface 62B of the removal member 62 is a surface that comes into contact with foreign matter adhered to the printing surface M1 of the medium M.

Since the removal member 62 is an aggregate of multiple fibers, the surface 62B of the removal member 62 has multiple protrusions and recesses. For example, if the removal member 62 is a member having a smooth outer surface (for example, a rubber plate), the surface 62B of the removal member 62 does not have multiple protrusions and recesses.

If the surface 62B of the removal member 62 has multiple protrusions and recesses, it is possible to enhance a force (a frictional force) that acts on the printing surface M1 of the medium M from the surface 62B of the removal member 62 in comparison with a case in which the surface 62B of the removal member 62 does not have multiple protrusions and recesses. Since the force that acts on the printing surface M1 of the medium M from the surface 62B of the removal member 62 corresponds to a force that removes foreign matter adhered to the printing surface M1 of the medium M, it is likely that the removal member 62 will remove the foreign matter adhered to the printing surface M1 of the medium M.

Accordingly, as a result of configuring the removal member 62 by using an aggregate of fibers, and providing protrusions and recesses in the surface 62B of the removal member 62, it is possible to enhance the foreign matter removal performance of the removal member 62.

Since the removal member 62 is an aggregate of multiple fibers, it is possible to form multiple spaces (hollow cavities) in the inner portion thereof. If the spaces are formed in the inner portion of the removal member 62, the foreign matter removed by the surface 62B of the removal member 62 is accommodated (held) in the spaces, and therefore, it is possible to suppress scattering of the foreign matter. That is, if the removal member 62 includes spaces in the inner portion thereof, it is possible to accommodate (hold) more foreign matter in the inner portion of the removal member 62, and it is possible to trap more foreign matter than in a case in which the removal member 62 does not include spaces in the inner portion thereof.

Accordingly, as a result of configuring the removal member 62 by using an aggregate of fibers, and forming spaces in the inner portion of the removal member 62, it is possible to enhance the foreign matter trapping performance of the removal member 62.

Additionally, in order to prevent a deterioration in the foreign matter trapping performance of the removal member 62, it is preferable that foreign matter trapped by the removal member 62 be eliminated at regular intervals by using a cleaning member (not illustrated in the drawings). For example, it is possible to easily eliminate the foreign matter trapped by the removal member 62 by transporting an adhesive sheet in place of the medium M.

For example, if the removal member 62 is configured by using a brush, in comparison with a case in which the removal member 62 is configured by an aggregate of fibers, the spaces in the inner portion of the brush are too wide, and therefore, it is less likely that foreign matter will be trapped (stored) in the inner portion of the brush. Therefore, it is likely that the foreign matter removed by the surface 62B of the removal member 62 will pass through the inner portion of the brush and adhere to the printing surface M1 of the medium M again.

For example, in a case in which the removal member 62 is configured by using a rubber plate, since spaces, which accommodate (hold) foreign matter in the inner portion thereof, are not provided, there is a concern that the foreign matter adhered to the printing surface M1 of the medium M would scatter (spread). Furthermore, if the removal member 62 is configured by using a rubber plate, there is a concern that a defect such as wrinkling or scuffing of the printing surface M1 of the medium M will occur.

Additionally, since the removal member 62 comes into contact with the printing surface M1 of the medium M at the surface 62B, it is unlikely that a defect such as wrinkling or scuffing of the printing surface M1 of the medium M will occur. Additionally, since the removal member 62 comes into contact with the printing surface M1 of the medium M at the surface 62B, it is unlikely that a defect such as wrinkling or scuffing of the printing surface M1 of the medium M will occur.

In this manner, if the removal member 62 is configured by using an aggregate of fibers, in comparison with a case in which the removal member 62 is configured by using a brush or a rubber plate, it is possible to enhance the foreign matter removal performance or the foreign matter trapping performance of the removal member 62, and it is unlikely that a defect such as wrinkling or scuffing of the printing surface M1 of the medium M will occur.

Accordingly, it is preferable that the removal member 62 be an aggregate of fibers.

FIG. 5 is a schematic view of a case in which the removal member 62 is fixed to the surface 61A of the holding member 61 inclined to the downstream side in the transport direction F with respect to the direction that is orthogonal to the transport surface H. In FIG. 5, the removal member 62 is fixed to the surface 61A of the holding member 61 so that the disposition angle θ of the removal member 62 is an obtuse angle.

Additionally, in FIG. 5, the removal member 62 is shown in an uncurved state in order to make a state in which the transport of the medium M is inhibited easy to understand.

If the medium M is transported from the setting unit 20 toward the transport unit 30 and a tip end of the medium M comes into contact with the removal member 62, a force that causes the removal member 62 to curve in the transport direction F is applied to the removal member 62 from the medium M, the removal member 62 curves in the transport direction F, and the medium M is transported in the transport direction F. Meanwhile, a force that resists the force that causes the removal member 62 to curve in the transport direction F is applied to the medium M from the removal member 62.

From this point onwards, the force that causes the removal member 62 to curve in the transport direction F, which is applied to the removal member 62 from the medium M, will be referred to as a force J in the transport direction. The force that resists the force that causes the removal member 62 to curve in the transport direction F, which is applied to the medium M from the removal member 62, will be referred to as a resistance K.

The resistance K is a reaction force to the force J in the transport direction, is applied in a direction opposite the transport direction F, and inhibits transport of the medium M. In addition, the resistance K is also applied to foreign matter adhered to the printing surface M1 of the medium M, and corresponds to a force that removes the foreign matter.

As shown in FIG. 4, in a case in which the removal member 62 is disposed inclined to the upstream side in the transport direction F with respect to the direction that is orthogonal to the transport surface H, since it is more likely that the removal member 62 will curve in the transport direction F than in a case in which the removal member 62 is disposed inclined to the downstream side in the transport direction F with respect to the direction that is orthogonal to the transport surface H, the force J in the transport direction (the force that causes the medium M to curve) is weaker, and therefore, the resistance K is also weaker. Since the resistance K is weaker, it is less likely that transport of the medium M will be inhibited, and therefore, the medium M is transported in the transport direction F.

As shown in FIG. 5, in a case in which the removal member 62 is disposed inclined to the downstream side in the transport direction F with respect to the direction that is orthogonal to the transport surface H, there is a concern that the medium M will become warped in a direction that intersects the transport direction F and transport of the medium M will be inhibited.

To explain in more detail, in a case in which the removal member 62 is disposed inclined to the downstream side in the transport direction F with respect to the direction that is orthogonal to the transport surface H, in comparison with a case in which the removal member 62 is disposed inclined to the upstream side in the transport direction F with respect to the direction that is orthogonal to the transport surface H, since it is less likely that the removal member 62 will curve in the transport direction F, the force J in the transport direction is stronger, and therefore, the resistance K is also stronger. If the resistance K is stronger, the medium M is subjected to the effect of the stronger resistance K, is more likely to become warped in the direction that intersects the transport direction F, and there is a concern that transport of the medium M will be inhibited.

Accordingly, in order to make it unlikely that transport of the medium M will be inhibited, it is preferable that the removal member 62 be disposed inclined to the upstream side in the transport direction F with respect to the direction that is orthogonal to the transport surface H. In a case in which the removal member 62 is not in contact with the printing surface M1 of the medium M, since the inclination of the removal member 62 with respect to the transport surface H is equivalent to the inclination of the surface 61A of the holding member 61 and the transport surface H is equivalent to the printing surface M1 of the medium M, it is preferable that the surface 61A of the holding member 61 to which the removal member 62 is fixed be inclined to the upstream side in the transport direction F with respect to the direction that is orthogonal to the printing surface M1 of the medium M.

In this manner, the ease with which curving of the removal member 62 occurs has an effect on the force J in the transport direction, which causes the removal member 62 to curve in transport direction F, and the resistance K, which is a reaction force to the force J in the transport direction. That is, if the disposition angle θ of the removal member 62 is small and the removal member 62 is likely to curve, the force J in the transport direction, which causes the removal member 62 to curve, and the resistance K are weak. If the disposition angle θ of the removal member 62 is large and the removal member 62 is unlikely to curve, the force J in the transport direction, which causes the removal member 62 to curve, and the resistance K are strong. Accordingly, the resistance K changes depending on the disposition angle θ of the removal member 62.

Since the resistance K is the force that removes foreign matter adhered to the printing surface M1 of the medium M, in order to enhance the foreign matter removal performance of the removal member 62, it is preferable that the resistance K be stronger within a range in which transport of the medium M is not inhibited. That is, in order to enhance the foreign matter removal performance of the removal member 62, it is preferable that the disposition angle θ of the removal member 62 be larger within a range in which transport of the medium M is not inhibited.

Figure 6:
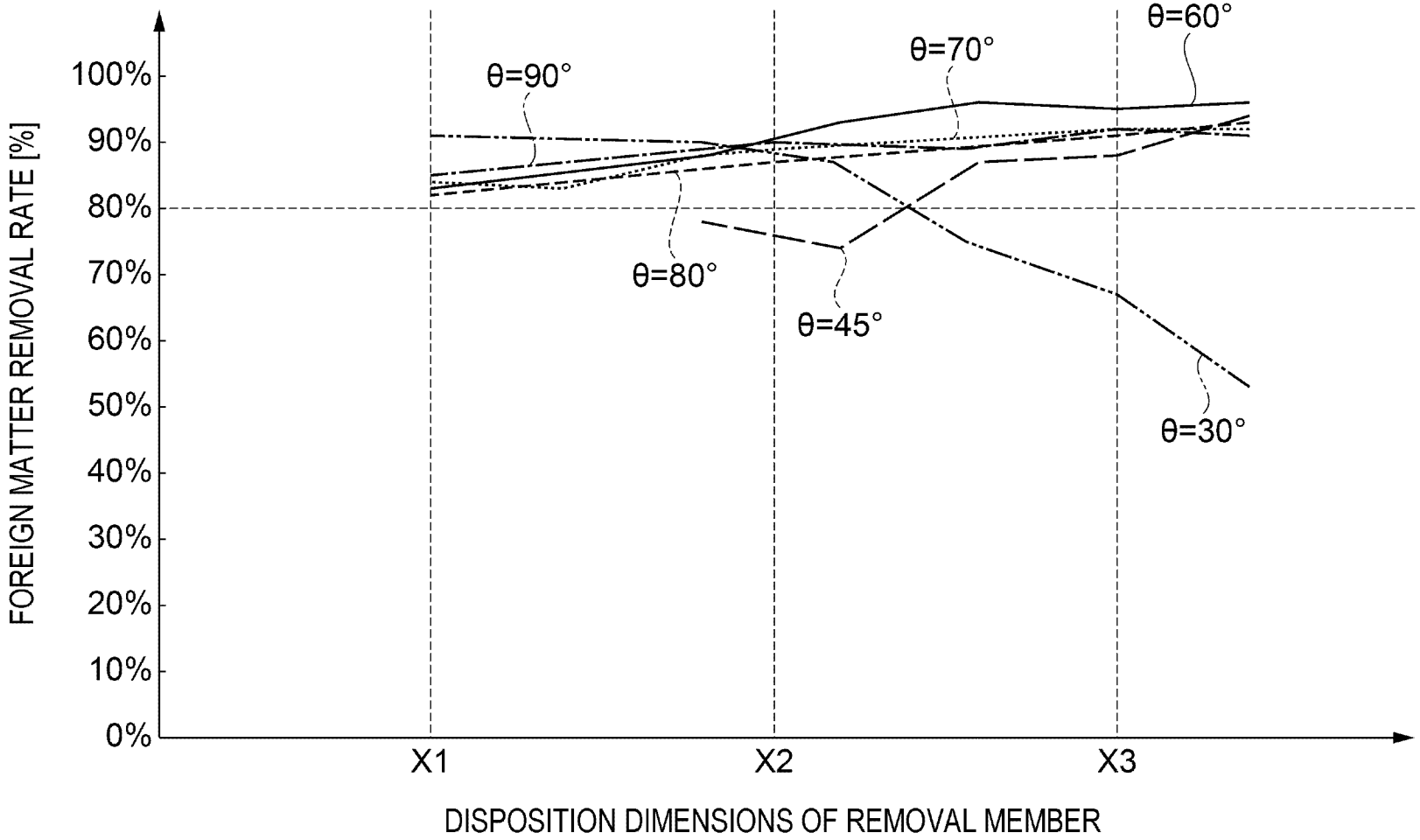
FIG. 6 is a graph that shows a relationship between a disposition dimension of the removal member and a foreign matter removal rate.

Preferred Conditions of Disposition Angle of Removal Member FIG. 6 is a graph that shows a relationship between a disposition dimension of the removal member and a foreign matter removal rate. The horizontal axis of the drawing represents the disposition dimension D of the removal member 62 and the vertical axis of the drawing represents the foreign matter removal rate. In the drawing, relationships between the disposition dimension D of the removal member 62 and the foreign matter removal rate of cases in which the disposition angle θ of the removal member 62 is 30°, 45°, 60°, 70°, and 80°, 90° are shown.

The foreign matter removal rate is a ratio of the number of items of foreign matter removed from the printing surface M1 by the removal unit 60 relative to the number of items of foreign matter adhered to the printing surface M1 prior to the removal of the foreign matter by using the removal unit 60.

The inventors carried out a detailed evaluation of the relationship between the foreign matter removal rate and the printing quality of a printed image, and discovered that if the foreign matter removal rate is greater than 80%, adverse effects (decreases in printing quality) caused by foreign matter are substantially suppressed, and it is possible for the printing apparatus 10 to realize a practical printing quality in a stable manner.

Furthermore, depending on dimensional tolerances, assembly tolerances, and the like, of the members that configure the printing apparatus 10, if the disposition dimension D of the removal member 62 is less than X1, there are cases in which the tip end 62A of the removal member 62 is not in contact with the printing surface M1 of the medium M. In a case in which the tip end 62A of the removal member 62 is not in contact with the printing surface M1 of the medium M, the foreign matter removal performance of the removal member 62 decreases significantly. Accordingly, it is preferable that the disposition dimension D of the removal member 62 be X1 or more.

In addition, if a design value (target value) of the disposition dimension D of the removal member 62 is X2, depending on the dimensional tolerances, the assembly tolerances, and the like, of the members, the disposition dimension D of the removal member 62 is controlled to be in a range of X1 to X3. Since it is preferable that the disposition dimension D of the removal member 62 be smaller in order to achieve miniaturization of the printing apparatus 10, it is preferable that the design value (target value) of the disposition dimension D of the removal member 62 be set to X2, and the disposition dimension D of the removal member 62 be controlled to be in the range of X1 to X3.

In a case in which the disposition dimension D of the removal member 62 is in the range of X1 to X3, if the foreign matter removal rate is greater than 80%, it is possible for the printing apparatus 10 to realize a practicable printing quality in a stable manner. That is, in a case in which the disposition dimension D of the removal member 62 is in the range of X1 to X3, the disposition angle θ of the removal member 62 at which the foreign matter removal rate is greater than 80% corresponds to a preferred condition at which it is possible for the printing apparatus 10 to realize a practicable printing quality in a stable manner.

Hereinafter, the preferred condition of the disposition angle θ of the removal member 62 will be described with reference to FIG. 6.

As shown in FIG. 6, in a case in which the disposition angle θ of the removal member 62 is 30°, in the range in which the disposition dimension D of the removal member 62 is X1 to X3, the foreign matter removal rate is in a range of approximately 68-91%. To explain in more detail, in a range in which the disposition dimension D of the removal member 62 is X1 to X2, since the foreign matter removal rate is greater than 80%, it is possible for the printing apparatus 10 to realize a practicable printing quality in a stable manner. However, if the disposition dimension D of the removal member 62 is greater than X2, since the foreign matter removal rate gradually decreases and the foreign matter removal rate is less than 80%, it is not possible for the printing apparatus 10 to realize a practicable printing quality in a stable manner.

It is considered that if the disposition dimension D of the removal member 62 is greater than X2, that is, if the length of the removal member 62 in a short edge direction is great, the foreign matter removal rate decreases since it is likely that the removal member 62 will curve and the resistance K (the force that removes foreign matter) is weak.

In a case in which the disposition angle θ of the removal member 62 is 45°, in the range in which the disposition dimension D of the removal member 62 is X2 to X3, the foreign matter removal rate is in a range of approximately 75-88%, and since there is a section that is smaller than the foreign matter removal rate (80%) at which it is possible to realize a practicable printing quality, it is not possible for the printing apparatus 10 to realize a practicable printing quality in a stable manner.

In the above-mentioned manner, if the disposition dimension D of the removal member 62 is large, it is likely that the removal member 62 will curve, and since the resistance K (the force that removes foreign matter) is weak, in a case in which the disposition angle θ of the removal member 62 is 45°, there is a section in which the foreign matter removal rate is less than 80%.

Meanwhile, if the disposition dimension D of the removal member 62 is large, since a contact area of the surface 62B of the removal member 62 and the printing surface M1 of the medium M is large, the resistance K is applied to foreign matter from the surface 62B of the removal member 62 for a long period of time. It is considered that if the time during which the resistance K is applied is long, the effect of the resistance K being weak is offset, and the foreign matter removal rate is conversely high in the range in which the disposition dimension D of the removal member 62 is X2 to X3.

In a case in which the disposition angle θ of the removal member 62 is 60°, since the resistance K (the force that removes foreign matter) is stronger, it is considered that the foreign matter removal rate is higher than in a case in which the disposition angle θ of the removal member 62 is either 30° or 45°. Therefore, in a case in which the disposition angle θ of the removal member 62 is 60°, in the range in which the disposition dimension D of the removal member 62 is X1 to X3, the foreign matter removal rate is in a range of approximately 83% to 96%, and since the foreign matter removal rate is greater than the foreign matter removal rate (80%) at which it is possible to realize a practicable printing quality, it is possible for the printing apparatus 10 to realize a practicable printing quality in a stable manner.

Similarly, in a case in which the disposition angle θ of the removal member 62 is 70°, since the resistance K (the force that removes foreign matter) is stronger, it is considered that the foreign matter removal rate is higher than in a case in which the disposition angle θ of the removal member 62 is either 30° or 45°. Therefore, in a case in which the disposition angle θ of the removal member 62 is 70°, in the range in which the disposition dimension D of the removal member 62 is X1 to X3, the foreign matter removal rate is in a range of approximately 83% to 92%, and since the foreign matter removal rate is greater than the foreign matter removal rate (80%) at which it is possible to realize a practicable printing quality, it is possible for the printing apparatus 10 to realize a practicable printing quality in a stable manner.

Similarly, in a case in which the disposition angle θ of the removal member 62 is 80°, since the resistance K (the force that removes foreign matter) is stronger, it is considered that the foreign matter removal rate is higher than in a case in which the disposition angle θ of the removal member 62 is either 30° or 45°. Therefore, in a case in which the disposition angle θ of the removal member 62 is 80°, in the range in which the disposition dimension D of the removal member 62 is X1 to X3, the foreign matter removal rate is in a range of approximately 83% to 92%, and since the foreign matter removal rate is greater than the foreign matter removal rate (80%) at which it is possible to realize a practicable printing quality, it is possible for the printing apparatus 10 to realize a practicable printing quality in a stable manner.

Similarly, in a case in which the disposition angle θ of the removal member 62 is 90°, since the resistance K (the force that removes foreign matter) is stronger, it is considered that the foreign matter removal rate is higher than in a case in which the disposition angle θ of the removal member 62 is either 30° or 45°. Therefore, in a case in which the disposition angle θ of the removal member 62 is 90°, in the range in which the disposition dimension D of the removal member 62 is X1 to X3, the foreign matter removal rate is in a range of approximately 86% to 92%, and since the foreign matter removal rate is greater than the foreign matter removal rate (80%) at which it is possible to realize a practicable printing quality, it is possible for the printing apparatus 10 to realize a practicable printing quality in a stable manner.

Accordingly, in order for the printing apparatus 10 to realize a practicable printing quality in a stable manner, it is preferable that the disposition angle θ of the removal member 62 be 60°-90°.

In a case in which the removal member 62 is not in contact with the printing surface M1 of the medium M, since the disposition angle θ of the removal member 62 is the angle formed by the surface 61A of the holding member 61 and the printing surface M1, it is preferable that the angle formed by the surface 61A of the holding member 61 to which the removal member 62 is fixed and the printing surface M1 of the medium M be 60°-90°.

Additionally, the setting unit 20 is not an essential component of the present application. That is, the printing apparatus according to the present application may include the setting unit 20 or not include the setting unit 20. Furthermore, the medium M of the present application may have a configuration that is wound in the rolled body R in a rolled form, or may be single sheet paper (a configuration that is cut off one sheet at a time).

REFERENCE SIGNS LIST

10 PRINTING APPARATUS
11 LEG PORTION
12 HOUSING PORTION
13 FEEDING PORT
14 MANIPULATION PORTION
15 EJECTION PORT
18 FIXING MEMBER
30 TRANSPORT PORTION
31 DRIVING ROLLER
32 DRIVEN ROLLER
33 GUIDE ROLLER
40 PRINTING MAIN BODY PORTION
41 RECORDING HEAD
41A NOZZLE FORMATION SURFACE
42 CARRIAGE
45 PLATEN
50 CONTROL PORTION
60 REMOVAL PORTION
61 HOLDING MEMBER
62 REMOVAL MEMBER
F TRANSPORT DIRECTION
M MEDIUM
M1 PRINTING SURFACE

The invention claimed is:

1. A printing apparatus comprising:
a transport unit that transports a medium in a transport direction, the transport unit includes a plurality of rollers;
a printing unit that prints on a printing surface of the medium; and
a removal unit that is provided on an upstream side in the transport direction with respect to the transport unit,
wherein the removal unit includes a removal member that is in contact with the printing surface and a holding member that holds the removal member, and
wherein the removal member is an aggregate of fibers,
wherein the removal member is in contact with the printing surface upstream of a roller in the transport direction, the roller being positioned furthest on the upstream side in the transport direction among the plurality of rollers.

2. The printing apparatus according to claim 1,
wherein the removal member has a conductive property.

3. The printing apparatus according to claim 1, further comprising:
a setting unit in which a rolled body is mounted and which reels out the medium to the transport unit, the rolled body being in which the medium is wound,
wherein the removal member is in contact with the printing surface between the setting unit and the transport unit in the transport direction.

4. The printing apparatus according to claim 1,
wherein a surface of the holding member to which the removal member is fixed is inclined to the upstream side in the transport direction with respect to a direction that is orthogonal to the printing surface.

5. The printing apparatus according to claim 1,
wherein an angle formed by a surface of the holding member to which the removal member is fixed and the printing surface is equal to or larger than 60° and is equal to or smaller than 90°.

6. The printing apparatus according to claim 1,
wherein the removal member extends along a transverse axis direction and curves in the transport direction while the medium is transported in the transport direction, the transverse axis direction being orthogonal to both the transport direction and vertical direction.

7. The printing apparatus according to claim 6,
wherein the removal member is configured by at least one of a non-woven fabric, a felt, and a cloth.

8. The printing apparatus according to claim 1,
wherein the removal member is configured by at least one of a non-woven fabric, a felt, and a cloth.

9. A printing apparatus comprising:
a transport unit that transports a medium in a transport direction;
a printing unit that prints on a printing surface of the medium; and
a removal unit that is provided on an upstream side in the transport direction with respect to the transport unit,
wherein the removal unit includes a removal member that is in contact with the printing surface and a holding member that holds the removal member, and
wherein the removal member is an aggregate of fibers,
wherein a surface of the holding member to which the removal member is fixed is inclined to the upstream side in the transport direction with respect to a direction that is orthogonal to the printing surface.

10. A printing apparatus comprising:
a transport unit that transports a medium in a transport direction;
a printing unit that prints on a printing surface of the medium; and
a removal unit that is provided on an upstream side in the transport direction with respect to the transport unit,
wherein the removal unit includes a removal member that is in contact with the printing surface and a holding member that holds the removal member, and
wherein the removal member is an aggregate of fibers,
wherein the removal member extends along a transverse axis direction and curves in the transport direction while the medium is transported in the transport direction, the transverse axis direction being orthogonal to both the transport direction and vertical direction.

* * * * *